US008522869B2

(12) United States Patent
Noya et al.

(10) Patent No.: US 8,522,869 B2
(45) Date of Patent: Sep. 3, 2013

(54) OPTICAL COILED TUBING LOG ASSEMBLY

(75) Inventors: Jose Vidal Noya, Marly le Roi (FR); Soon Seong Chee, Tokyo (JP); Sarmad Adnan, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 332 days.

(21) Appl. No.: 12/569,341

(22) Filed: Sep. 29, 2009

(65) Prior Publication Data

US 2010/0084132 A1 Apr. 8, 2010

Related U.S. Application Data

(63) Continuation-in-part of application No. 11/135,314, filed on May 23, 2005, now Pat. No. 7,617,873.

(60) Provisional application No. 60/575,327, filed on May 28, 2004.

(51) Int. Cl.
*E21B 19/08* (2006.01)

(52) U.S. Cl.
USPC ..... 166/254.2; 166/384; 166/77.2

(58) Field of Classification Search
USPC ..... 166/254.2, 385, 384, 77.2, 242.2, 166/242.4
See application file for complete search history.

(56) References Cited

U.S. PATENT DOCUMENTS 2,558,427 A 6/1951 Fagan
2,651,027 A * 9/1953 Vogel ..... 367/142
4,859,054 A 8/1989 Harrison
5,042,903 A * 8/1991 Jakubowski ..... 385/101
5,434,395 A 7/1995 Storck et al.
5,485,745 A 1/1996 Rademaker et al.
5,542,471 A 8/1996 Dickinson
5,573,225 A 11/1996 Boyle et al.
5,898,517 A 4/1999 Weis
5,992,250 A 11/1999 Kluth et al.
5,996,689 A * 12/1999 Head ..... 166/77.2

(Continued)

FOREIGN PATENT DOCUMENTS

DE 2818656 A1 10/1979
DE 29816469 2/1999

(Continued)

OTHER PUBLICATIONS

Wolfbeis et al., Fiber Optic Fluorosensor for Oxygen and Carbon Dioxide, Anal. Chem 60. p. 2028-2030, 1998.

(Continued)

*Primary Examiner* — William P Neuder
(74) *Attorney, Agent, or Firm* — Michael Flynn

(57) ABSTRACT

A fiber optic based logging assembly deliverable via coiled tubing. The downhole portion of the assembly is directed to develop a logging profile of a well by way of the fiber optic line. Thus, a downhole battery may be provided with the tool. Further, opto-electric interfaces may be provided with the assembly to convert between electrical and optical communication signals. Additionally, with the reduced profile of an optical communication line through the coiled tubing portion of the assembly, an operator may elect to perform treatment applications in real-time. That is, in certain circumstances, the operator may direct a treatment application utilizing the downhole assembly in response to the developing well profile (i.e. without first requiring that the assembly be withdrawn and replaced with a solely dedicated treatment assembly).

26 Claims, 6 Drawing Sheets

(56) References Cited

U.S. PATENT DOCUMENTS

| | | | | |
|---|---|---|---|---|
| 6,009,216 | A | 12/1999 | Pruett et al. | |
| 6,157,893 | A | 12/2000 | Berger et al. | |
| 6,192,983 | B1 | 2/2001 | Neuroth et al. | |
| 6,247,536 | B1 | 6/2001 | Leismer et al. | |
| 6,281,489 | B1 * | 8/2001 | Tubel et al. | 250/227.14 |
| 6,323,420 | B1 * | 11/2001 | Head | 174/47 |
| 6,349,768 | B1 | 2/2002 | Leising | |
| 6,392,151 | B1 | 5/2002 | Rafie et al. | |
| 6,419,014 | B1 | 7/2002 | Meek et al. | |
| 6,474,152 | B1 | 11/2002 | Mullins et al. | |
| 6,497,290 | B1 * | 12/2002 | Misselbrook et al. | 166/384 |
| 6,519,568 | B1 | 2/2003 | Harvey et al. | |
| 6,581,455 | B1 | 6/2003 | Berger et al. | |
| 6,667,280 | B2 | 12/2003 | Chang et al. | |
| 6,789,621 | B2 | 9/2004 | Wetzel et al. | |
| 6,817,410 | B2 | 11/2004 | Wetzel et al. | |
| 7,055,604 | B2 | 6/2006 | Jee et al. | |
| 7,140,435 | B2 | 11/2006 | Defretin et al. | |
| 7,152,685 | B2 | 12/2006 | Adnan et al. | |
| 7,182,134 | B2 | 2/2007 | Wetzel et al. | |
| 7,207,216 | B2 | 4/2007 | Meister et al. | |
| 7,308,941 | B2 | 12/2007 | Rolovic et al. | |
| 7,420,475 | B2 | 9/2008 | Adnan et al. | |
| 7,515,774 | B2 | 4/2009 | Vannuffelen et al. | |
| 7,617,873 | B2 | 11/2009 | Lovell et al. | |
| 7,929,812 | B2 | 4/2011 | Vannuffelen et al. | |
| 2001/0050172 | A1 | 12/2001 | Tolman et al. | |
| 2002/0007945 | A1 * | 1/2002 | Neuroth et al. | 166/66 |
| 2002/0017386 | A1 | 2/2002 | Ringgenberg et al. | |
| 2002/0125008 | A1 | 9/2002 | Wetzel et al. | |
| 2004/0020653 | A1 | 2/2004 | Smith | |
| 2004/0045705 | A1 | 3/2004 | Gardner et al. | |
| 2004/0084190 | A1 | 5/2004 | Hill et al. | |
| 2004/0129418 | A1 | 7/2004 | Jee et al. | |
| 2005/0016730 | A1 | 1/2005 | McMechan et al. | |
| 2005/0126777 | A1 | 6/2005 | Rolovic et al. | |
| 2006/0044156 | A1 | 3/2006 | Adnan et al. | |
| 2006/0102347 | A1 | 5/2006 | Smith | |
| 2006/0152383 | A1 | 7/2006 | Yamate et al. | |
| 2006/0157239 | A1 | 7/2006 | Ramos et al. | |
| 2007/0126594 | A1 | 6/2007 | Atkinson et al. | |
| 2007/0137860 | A1 | 6/2007 | Lovell et al. | |
| 2010/0018703 | A1 | 1/2010 | Lovell et al. | |

FOREIGN PATENT DOCUMENTS

| | | | |
|---|---|---|---|
| EP | 0203249 | B1 | 12/1986 |
| EP | 0853249 | A1 | 7/1998 |
| GB | 2177231 | A | 1/1987 |
| GB | 2275953 | A | 9/1994 |
| GB | 2299868 | A | 10/1996 |

OTHER PUBLICATIONS

Maher et al., Journal of Testing and Evaluation, vol. 21, Issue 5, Sep. 1993.

Esteban et al., Measurement of the Degree of Salinity of Water with a Fiber-Optic Sensor, Applied Optics, vol. 38, Issue 25, 5267-5271, Sep. 1999.

Final Office Action issued in Related U.S. Appl. No. 11/135,314 dated Sep. 25, 2008, 8 pages.

Non-Final Office Action issued in Related U.S. Appl. No. 11/135,314 dated Feb. 19, 2009, 9 pages.

Notice of Allowance issued in Related U.S. Appl. No. 11/135,314 dated Jul. 7, 2009, 6 pages.

Non-Final Office Action issued in Related U.S. Appl. No. 12/575,024 dated Aug. 4, 2010, 10 pages.

Non-Final Office Action issued in Related U.S. Appl. No. 12/575,024 dated Feb. 22, 2012, 9 pages.

Final Office Action issued in Related U.S. Appl. No. 12/575,024 dated Dec. 21, 2012, 11 pages.

Examiner's Report issued in CA2,566,221 dated Oct. 3, 2011, 2 pages.

International Search Report and Written Opinion issued in PCT/IB2005/051734 on Aug. 5, 2005, 7 pages.

International Search Report and Written Opinion issued in PCT/US2010/050692 on Jun. 23, 2011.

* cited by examiner

OPTICAL COILED TUBING LOG ASSEMBLY

CROSS REFERENCE TO RELATED APPLICATION(S)

This Patent Document is a continuation-in-part claiming priority under 35 U.S.C. §120 to U.S. application Ser. No. 11/135,314 entitled System and Methods Using Fiber Optics in Coiled Tubing filed on May 23, 2005 now U.S. Pat. No. 7,617,873, incorporated herein by reference in its entirety and which in turn claims priority under 35 U.S.C. §119(e) to U.S. Provisional App. Ser. No. 60/575,327, also entitled System and Methods Using Fiber Optics in Coiled Tubing, filed on May 28, 2004, and also incorporated herein by reference in its entirety.

FIELD

Embodiments described relate to logging tools for use in establishing an overall profile of a well, such as hydrocarbon or other wells. In particular, techniques are described of employing such tools in conjunction with fiber optic communication so as to further real-time communications and follow on treatment applications.

BACKGROUND

Exploring, drilling and completing hydrocarbon and other wells are generally complicated, time consuming and ultimately very expensive endeavors. As a result, over the years, well architecture has become more sophisticated where appropriate in order to help enhance access to underground hydrocarbon reserves. For example, as opposed to vertical wells of limited depth, it is not uncommon to find hydrocarbon wells exceeding 30,000 feet in depth which are often fairly deviated with horizontal sections aimed at targeting particular underground reserves.

In recognition of the potentially enormous expense of well completion, added emphasis has been placed on well monitoring and maintenance. That is, placing added emphasis on increasing the life and productivity of a given well may help ensure that the well provides a healthy return on the significant investment involved in its completion. Thus, over the years, well diagnostics and treatment have become more sophisticated and critical facets of managing well operations.

In the case of non-vertical (i.e. 'horizontal') wells as noted above, the more sophisticated architecture may increase the likelihood of accessing underground hydrocarbons. However, the nature of such wells presents particular challenges in terms of well access and management. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Rather, coiled tubing is frequently employed to provide access to wells of more sophisticated architecture.

Coiled tubing operations are particularly adept at providing access to highly deviated or tortuous wells where gravity alone fails to provide access to all regions of the wells. During a coiled tubing operation, a spool of pipe (i.e., a coiled tubing) with a downhole tool at the end thereof is slowly straightened and forcibly pushed into the well. This may be achieved by running coiled tubing from the spool, at a truck or large skid, through a gooseneck guide arm and injector which are positioned over the well at the oilfield. In this manner, forces necessary to drive the coiled tubing through the deviated well may be employed, thereby advancing the tool through the well.

Well diagnostic tools and treatment tools may be advanced and delivered via coiled tubing as described above. Diagnostic tools, often referred to as logging tools, may be employed to analyze the condition of the well and its surroundings. Such logging tools may come in handy for building an overall profile of the well in terms of formation characteristics, well fluid and flow information, etc. In the case of production logging, such a profile may be particularly beneficial in the face of an unintended or undesired event. For example, unintended loss of production may occur over time due to scale buildup or other factors. In such circumstances, a logging tool may be employed to determine an overall production profile of the well. With an overall production profile available, the contribution of various well segments may be understood. Thus, as described below, corrective maintenance in the form of a treatment application may be performed at an underperforming well segment based on the results of the described logging application. For example, in the case of scale buildup as noted above, an acidizing treatment may subsequently be employed at the location of the underperforming segment.

Unfortunately, in circumstances where an accurate production profile is obtained via coiled tubing as described above, the entire coiled tubing must be removed before a treatment application may ensue. Once more, due to the challenging architecture of the well, the treatment application is again achieved via coiled tubing. Thus, a separate coiled tubing assembly must generally be available at the well site for delivery of a treatment tool (e.g. for an acidizing treatment at an underperforming well segment). In addition to added capital expense, this will ultimately cost a significant amount of time. That is, substantial time is lost in terms of withdrawal of the initial coiled tubing and rigging-up the subsequent coiled tubing for treatment, not to mention the time incurred in actually running the treatment application. All in all, several hours to days are often lost due to the duplicitous nature of such coiled tubing deployments.

The apparent redundancy in repeated coiled tubing deployments as described above, is due to the functional equipment requirements of conventional logging tools. For example, the logging tool is much more than a mere pressure or temperature sensor. Rather it is an electrically powered device that is equipped for significant data acquisition and communication with hardware at the surface of the oilfield. Therefore, the delivery of such tools includes the advancement of an electrical cable that powers the tool, such as a conventional wireline cable that also communicatively tethers the tool to hardware at the oilfield surface.

As a result of the presence of a cable through the coiled tubing as noted above, treatment applications through the coiled tubing are generally impractical. That is, the substantial diameter of the cable relative that of the coiled tubing occludes the coiled tubing so as to limit flow, ballistic actuation (e.g. 'ball drop'), and other features often employed in the subsequent treatment application. For example, a standard cable may be up to about 0.6 inches or more in diameter while disposed in coiled tubing having an inner diameter of generally less than about 2 inches. Furthermore, even in the case of low flow acidizing as noted above, the treatment itself is likely to damage the polymeric nature of the cable's outer layers. As a result, future communications with the logging tool would be impaired until the time and expense of cable replacement and/or repair were incurred. Thus, as a practical matter, coiled tubing logging applications generally remain followed by separately deployed coiled tubing treatment applications where necessary.

SUMMARY

A logging assembly is provided for disposal in a well. The assembly includes coiled tubing deployable from an oilfield surface adjacent the well with a fiber optic line disposed therethrough. A logging tool is coupled to the fiber optic line and is configured to acquire well information.

An assembly is also provided that includes coiled tubing deployable from an oilfield surface adjacent the well. The assembly also includes an interventional treatment device coupled to the coiled tubing so as to allow performance of an interventional application relative to the well. Additionally, a logging tool is provided coupled to the coiled tubing. The logging tool is configured to acquire well information for establishing an overall profile of the well.

DETAILED DESCRIPTION

Embodiments are described with reference to certain features and techniques of fiber optically enabled log assemblies that include coiled tubing for downhole delivery. As such, depicted embodiments focus on advantages such as well treatment capacity made available by the use of fiber optic communications with such coiled tubing log assemblies. Thus, embodiments are generally depicted with incorporated treatment tools. However, a variety of configurations may be employed with and without treatment tools. That is, an optically enabled coiled tubing log assembly may be employed apart from a follow-on treatment application. Regardless, embodiments described herein are employed that include a logging tool deliverable downhole via coiled tubing, while employing a fiber optic line for communications. Thus, at a minimum, enhanced high-speed communications may be made available via an overall lighter weight assembly.

Figure 1:
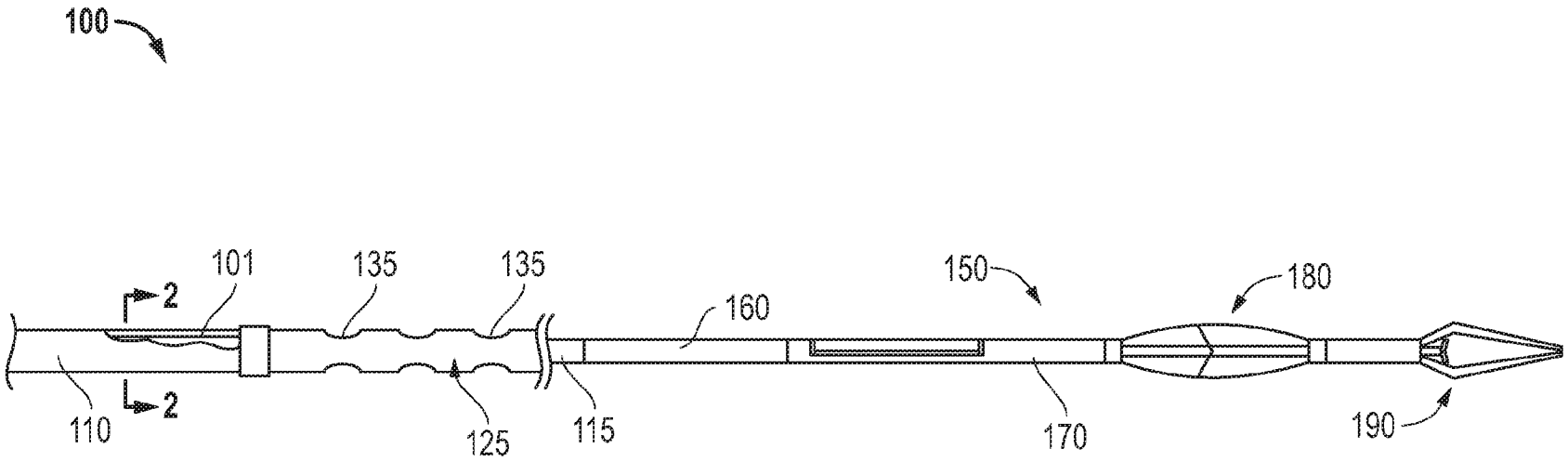
FIG. 1 is a side, partially-sectional, view of an embodiment of an optical coiled tubing log assembly.

Referring now to FIG. 1, an optical coiled tubing log assembly 100 is shown. The assembly 100 includes a logging tool 150 disposed at the end thereof and is configured for downhole advancement via coiled tubing 110. However, as noted above, a fiber optic line 101 is provided so as to provide communicative capacity between the logging tool 150 and surface delivery equipment 325 (see FIG. 3). Thus, a host of advantages are provided to the assembly 100. These advantages may even include well treatment capacity. As described below, such treatment capacity is made practical by the substantial amount of available coiled tubing volume 275 through which fluid or other treatment elements may proceed (see FIG. 2A). For example, in the embodiment shown, a treatment device 125 is incorporated into the assembly 100. In this embodiment, perforations 135 are provided through the device 125 such that an acidizing agent 500 may ultimately be delivered during a treatment application (see FIG. 5). However, a host of alternate types of treatment applications may be employed through the assembly 100.

Figure 3:
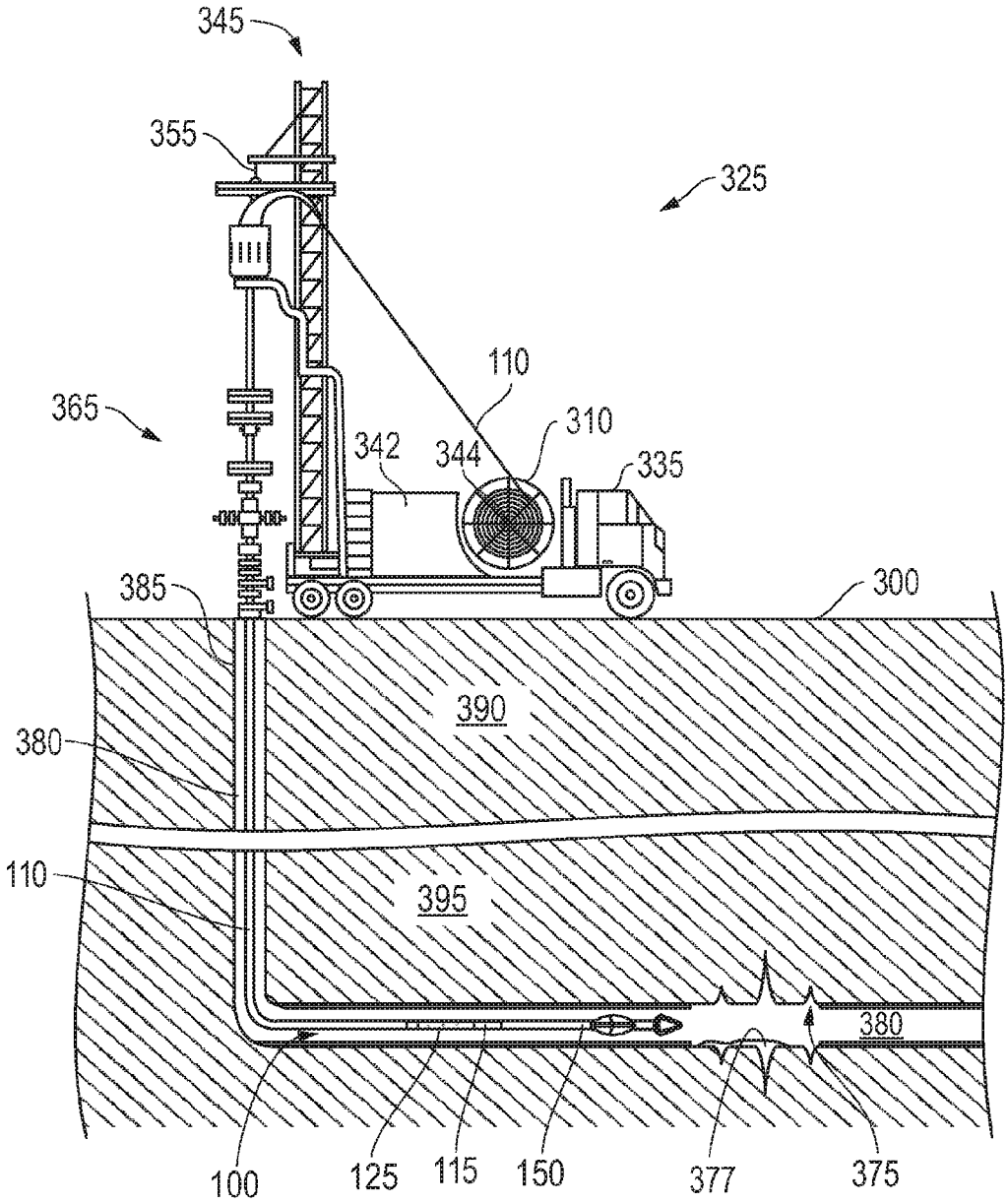
FIG. 3 is a partially sectional overview of a hydrocarbon well at an oilfield accommodating the assembly of FIG. 1 and surface equipment therefor.

Continuing with reference to FIG. 1, the logging tool 150 is configured to acquire a variety of logging data from a well 380 and surrounding formation layers 390, 395, such as those of FIG. 3. The use of a fiber optic line 101 substantially reduces the overall weight of the assembly 100 as compared to a conventional cable communications, while also providing high-bandwidth for reliable high speed data transfer, in addition to occupying a relatively small cross-section or footspace within the coiled tubing 110. More specifically, unlike a conventional cable, the fiber optic line 101 of the depicted assembly 100 may weigh substantially less than about ⅓ lb. per foot while also contributing substantially less than about 25% to the overall weight of the assembly 100. Additionally, as noted below, the line 101 may be of no more than about 0.25 inches in diameter, preferably less than about 0.125 inches (i.e. substantially less than about 0.3 inches as would be expected for a conventional electrical cable). Thus, as detailed further, available coiled tubing volume 275 remains, for example, as a suitable channel for actuation of downhole treatment applications.

While being ideally suited for high speed communications, the use of fiber optic material for the line 101 also eliminates electrical conveyance, such as copper wiring. This allows for the weight of the line 101 to be substantially reduced as compared to a conventional cable. Therefore, powering of the logging tool 150, treatment tool 125, and any other downhole device may be achieved by a downhole power source (see the battery 490 of FIG. 4B). Along these lines, a downhole opto-electric interface 115 is provided such that electrical and light signals may be converted as necessary for communication between electrically powered tools 125, 150 and the fiber optic line 101.

In the embodiment of FIG. 1, the logging tool 150 includes a host of well profile generating equipment or implements. This equipment may be configured for production logging directed at acquiring well fluids and formation measurements from which an overall production profile may be developed. However, in other embodiments, alternate types of logging may be sought. The noted equipment includes a sonde 160 equipped to acquire basic measurements such as pressure, temperature, casing collar location, and others. Density acquisition 170 and gas monitoring 180 devices are also provided. The tool 150 also terminates at a caliper and flow imaging tool 190 which, in addition to imaging, may be employed to acquire data relative to tool velocity, water, gas, flow and other well characteristics. As indicated, this information may be acquired at surface in a high speed manner, and, where appropriate, put to immediate real-time use (e.g. via a treatment application).

Figure 2B:
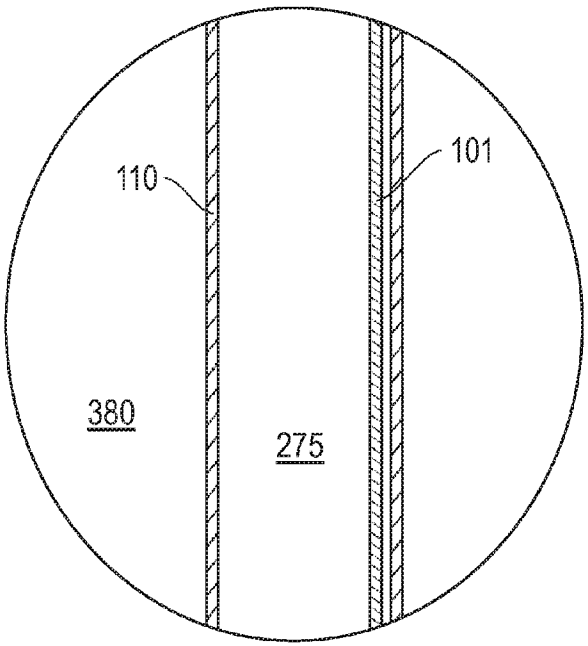
FIG. 2B is an alternate side cross sectional view of the log assembly of FIG. 1.
Figure 2A:
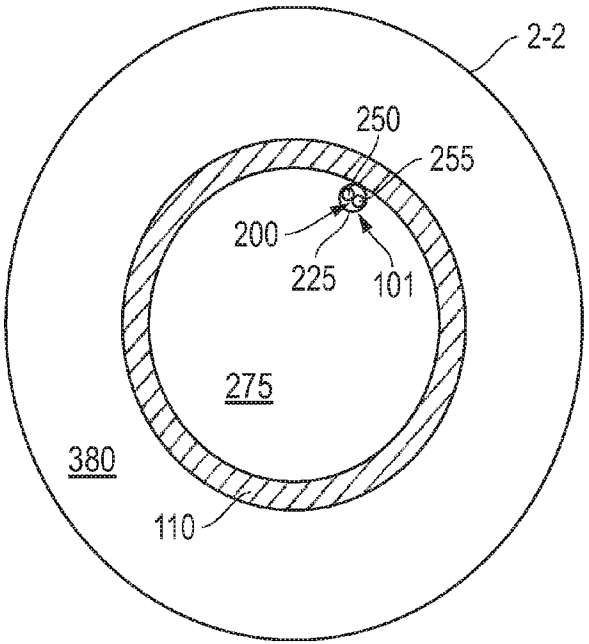
FIG. 2A is a cross-sectional view of the log assembly taken from 2-2 of FIG. 1.

Referring now to FIGS. 2A and 2B, cross-sectional views of the assembly 100 are shown. These views are of the coiled tubing 110 portion of the assembly 100 disposed within a well 380. In particular, the relationship of the fiber optic line 101 relative the surrounding tubing 110 is visible. For example, FIG. 2A is a cross-sectional view taken from 2-2 of FIG. 1. In this view, the available coiled tubing volume 275, un-occluded by the relatively small line 101 is quite apparent. As noted above, the line 101 may take up no more than about 0.25 inches in diameter at the most, whereas the inner diameter of the tubing 110 is substantially greater than about 1 inch, preferably over 2 inches. Thus, the available un-occluded volume 275 is sufficient for effective channeling of fluid or other treatment elements for a downhole treatment application. The application may even proceed without increase in friction losses.

The cross-sectional view of FIG. 2A, also reveals internal features of the fiber optic line 101. Namely, the line 101 may be made up of a core 200 of separate fibers 250, 255 surrounded by a protective casing 225. The fibers 250, 255 may include a transmission fiber 250 to carry downhole transmissions of light from an uphole light source 440 located at surface (of an oilfield 300) (see FIGS. 3 and 4A). A return fiber 255 may also be included to carry uphole transmissions of light originating from a downhole light source 441 at a downhole opto-electric interface 115 (see FIG. 4B).

The casing 225 surrounding the core 200 of fibers 250, 255 may be of a metal based material such as stainless steel, an austenitic nickel-chromium-based superalloy, such as inconel, a transition metal nickel, or other appropriate temperature and/or corrosion resistant metal based material. For example, in other embodiments, acid resistant carbon or polymer-based coatings may be utilized. Corrosion resistance to acid and hydrogen sulfide, may be of particular benefit. Indeed, the line 101 may be well protected for use in a well environment and in light of any follow on treatment application, such as acidizing treatment channeled through the available volume 275 of the coiled tubing 110.

In alternate embodiments, more than two fibers may be employed for transmitting of light-based data communications between the surface and downhole tools such as the logging tool 150 of FIG. 1. In fact, in one particular embodiment, a single fiber is employed for communicative transmissions in both uphole and downhole directions. For example, in such an embodiment, downhole transmissions may be of a given frequency that is different from that of uphole transmissions. In this manner, both uphole and downhole transmissions may take place over the same fiber and at the same time without conflict.

Referring now to FIG. 3, an overview of a hydrocarbon well 380 at an oilfield 300 is depicted. In the embodiment shown, the well 380 is defined by a casing 385. However, embodiments of equipment, tools and techniques described herein may be employed in an un-cased or open-hole well. In the depiction of FIG. 3, the well 380 accommodates the optical coiled tubing log assembly 100 during a logging and/or treatment application. More specifically, in the embodiment shown, a production logging application may be run with the assembly 100 followed by a treatment application that employs the same assembly 100. Indeed, depending on parameters of the operation, the production log and treatment application may both be run without any intervening removal of the assembly 100 from the downhole location as shown.

Continuing with reference to FIG. 3, the assembly 100 is positioned downhole and directed toward a previously fractured production region 375. Thus, the logging tool 150 is employed for building a production profile of the well 380. In the depiction of FIG. 3, debris 377 such as scale may be present at the production region 375. Indeed, the presence of such debris 377 may be discovered and evaluated via the described production logging. Therefore, in one embodiment, as noted above, a follow-on treatment application may take place in real-time, via the treatment tool 125. That is, the logging application may be completed, or even temporarily halted, and the treatment tool 125 positioned for a treatment application directed at the debris 377. In this manner, the advancing assembly 100 is equipped for real-time adjustment to operational parameters based on the production log data that is being acquired. While the treatment described is acidizing (see FIG. 5B), other forms of cleanout may take place in a similar manner. Indeed, alternate treatment applications such as matrix stimulation, fracturing, zonal isolation, perforating, fishing, milling, and even the shifting of a casing sleeve, may take place through such an optical coiled tubing log assembly 100.

Advancement of the assembly 100 as described above is directed via the coiled tubing 110. Surface delivery equipment 325, including a coiled tubing truck 335 with reel 310, is positioned adjacent the well 380 at the oilfield 300. The coiled tubing 110 may be pre-loaded with the fiber optic line 101 of FIG. 1 by pumping a fluid into the coiled tubing 110 which in turn pulls the fiber optic line 101 relative to the coiled tubing 110 due to frictional forces. The terminal end of the line 101 may then be coupled to the interface 115 described below with appropriate electrically powered downhole tools 125, 150 attached. With the coiled tubing 110 run through a conventional gooseneck injector 355 supported by a rig 345 over the well 380, the coiled tubing 110 and assembly 100 may then be advanced. That is, the coiled tubing 110 may be forced down through valving and pressure control equipment 365, often referred to as a 'Christmas tree', and through the well 380 (e.g. allowing a production logging application to proceed).

The above manner of advancing the coiled tubing 110 and assembly 100, and initiating a logging application, may be directed by way of a control unit 342. In the embodiment shown, the control unit 342 is computerized equipment secured to the truck 335. However, the unit 342 may be of a more mobile variety such as a laptop computer. Additionally, powered controlling of the application may be hydraulic, pneumatic and/or electrical. Regardless, the wireless nature of the direction allows the unit 342 to control the operation, even in circumstances where subsequent different application assemblies are to be deployed downhole. That is, the need for a subsequent mobilization of control equipment may be eliminated.

As detailed further below, the unit 342 wirelessly communicates with a transceiver hub 344 of the coiled tubing reel 310. The receiver hub 344 is coupled to a surface opto-electric interface 400 housed at the reel 310 and configured for converting electronic signals to optical signals and vice versa so as to allow communication between the line 101 and the hub 344 (see FIG. 4A). Similarly, the downhole opto-electric interface 115 is provided at the downhole end of the assembly 100 so as to allow communication between the electrically powered tools 125, 150 and the line 101 (see FIG. 4B).

Figure 4A:
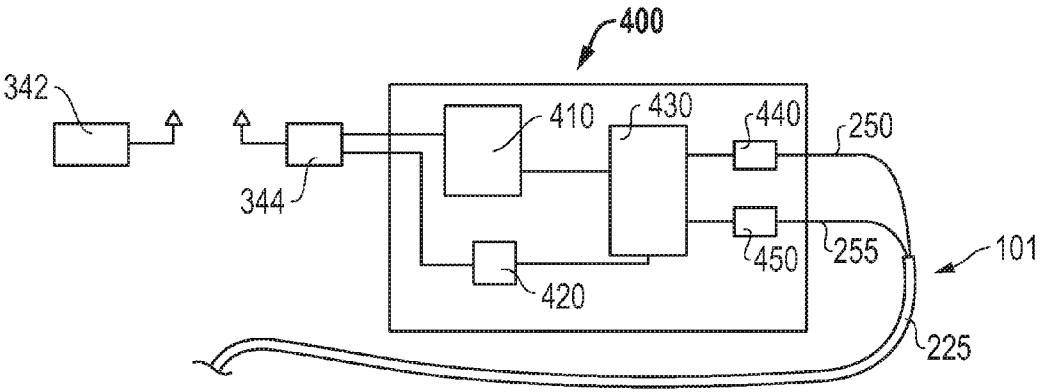
FIG. 4A is a schematic representation of an embodiment of a surface opto-electric interface for the surface equipment of FIG. 3.
Figure 4B:
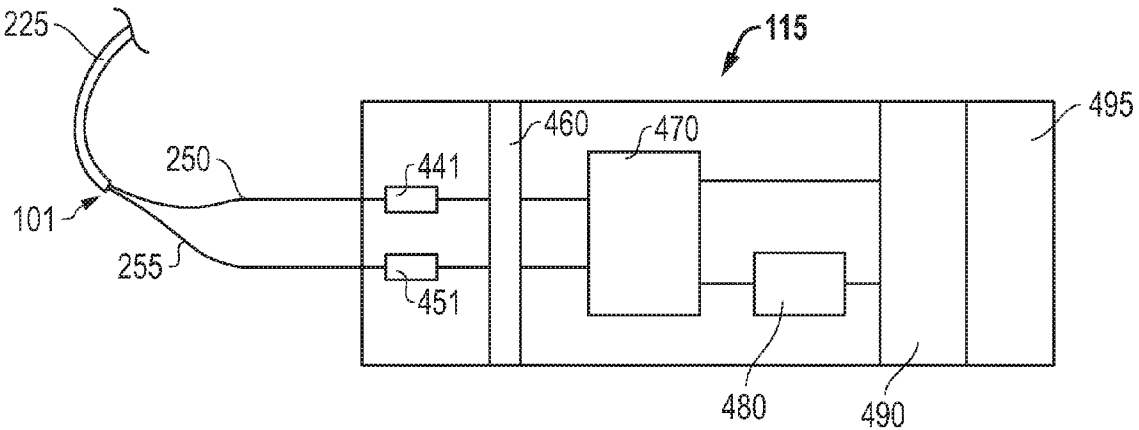
FIG. 4B is a schematic representation of an embodiment of a downhole opto-electric interface for the log assembly of FIG. 3.

Referring now to FIGS. 4A and 4B, with added reference to FIG. 3, the above described opto-electric interfaces 400, 115 are depicted. As indicated, the surface interface 400 is configured to wirelessly communicate with a surface control unit 342 via a transceiver hub 344. From the hub 344, electronic signal may be processed through data protocol 410 and converter 430 boards, ultimately exchanging electronic signal for optical signal via an optical transmitter 440 and receiver 450.

That is, while incoming optical signal may be received by the receiver, outgoing signal may leave the surface interface 400 as light by way of the transmitter 440. The transmitter 440 may be a conventional broadband fiber optic light source such as a traditional light emitting diode or a laser diode. Additionally, it is worth noting that the exchange of data between the downhole assembly 100 and the control unit 342 includes data for directing a battery 490 associated with the downhole tools 125, 150. Thus, a dedicated port 420 is provided at the surface interface 400 for channeling of such data.

In FIG. 4B, the fiber optic line 101 is depicted with the separate fibers 250, 255 individually terminating at the downhole interface 115. More specifically, the fibers 250, 255 emerge from the protective casing 225, to couple with a downhole light source 441 and receiver 451. Note that each fiber is dedicated to either uphole or downhole data transmission. That is, in the embodiment shown, the transmission fiber 250 directs signal downhole whereas the return fiber 255 directs signal uphole. However, in other embodiments, the line 101 may employ non-dedicated fiber utilizing two way transmission (e.g. over differing frequencies). Regardless, once terminating, the fibers are exchanged for electrical circuitry that is routed through a pressure barrier 460. In this manner, the downhole tools 125, 150 may be isolated from any well or application fluids present within the coiled tubing 110. Nevertheless, the circuitry alone continues on to a converter 470 and power 480 boards. Ultimately signal is carried to the battery 490 for directing actuation of the downhole tools 125, 150. In the embodiment shown, the tools 125, 150 are linked to the battery 490 through a downhole coupling 495 which may include conventional disconnect and quickstab features.

Figure 5B:
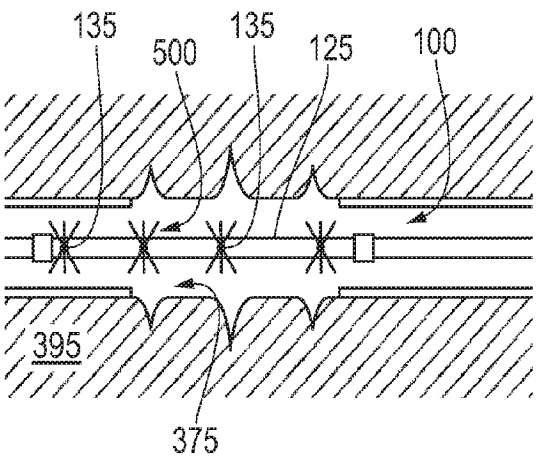
FIG. 5B is a partially sectional side view off the production region of FIG. 5A accommodating a treatment tool of the assembly of FIG. 3.
Figure 5A:
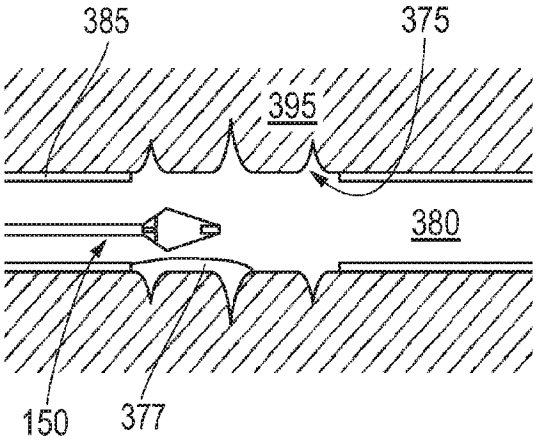
FIG. 5A is a partially sectional side view of a production region of the well accommodating a logging tool of the assembly of FIG. 3.

Referring now to FIGS. 5A and 5B, enlarged depictions of the production region 375 of FIG. 3 are shown. The production region 375 includes formation perforations extending from the well 380 and into the adjacent formation 395. Yet, as a production logging application is run, with the logging tool 150 entering the region 375, the emerging production profile may reveal a production issue. That is, as depicted in FIG. 5A, a build-up of debris 377 may affect the expected production in the region 375. Therefore, as depicted in FIG. 5B, a review of the production profile may lead to continued advancement of the assembly 100 for positioning of the treatment tool 125 to the region 375. Due to the nature of the fiber optic communications employed as detailed hereinabove, the treatment tool 125 may be employed in real-time to remove the debris 377. In the embodiment shown, the debris 377 may be scale that is broken down by way of an appropriate acidizing agent 500 emitted through perforations 135 in the tool 125.

Figure 6:
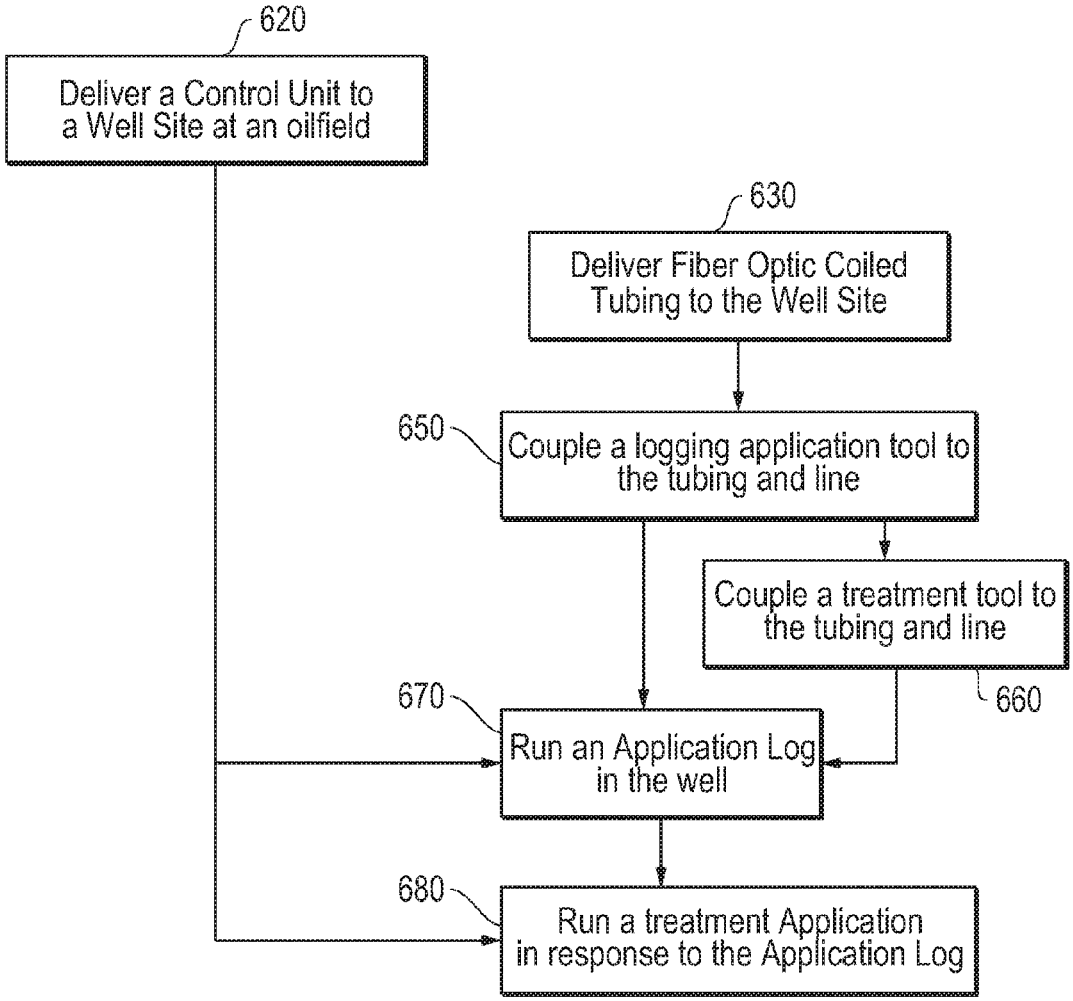
FIG. 6 is a flow-chart summarizing an embodiment of logging and treating a well with an optical coiled tubing log assembly.

Referring now to FIG. 6, a flow-chart summarizing an embodiment of employing an optical coiled tubing log assembly is depicted. As indicated at 620 and 630 a control unit and coiled tubing equipment are delivered to a well site at an oilfield. The control unit may be no more than a laptop computer with the capacity to wirelessly direct a logging application and potentially any follow-on treatment applications. As noted, the coiled tubing is equipped with a fiber optic line. Additionally, as indicated at 650, a logging tool will eventually be coupled to the coiled tubing and the fiber optic line (e.g. through an opto-electric interface if necessary). Thus, a logging application may be run in the well (see 670) as directed by the control unit.

As indicated at 660, certain treatment tools may also be coupled to the coiled tubing and fiber optic line in advance of the logging application. Thus, a subsequent treatment application may be run as indicated at 680 without necessarily removing or replacing the coiled tubing with one configured exclusively for treatment. As detailed above, this is made practical by the narrow profile of the line, coupled to the tools through any necessary opto-electric interfacing (as also noted). Of course, in alternate embodiments however, the optical coiled tubing log assembly may be removed and reconfigured or replaced with an assembly directed solely at treatment. In either case, the entire operation may continue to be directed by the small footprint of a single control unit which may consist of no more than a laptop computer.

Embodiments described hereinabove include a coiled tubing log assembly that avoids use of an electronic cable therethrough for powering and communications. Thus, higher speed more reliable communications are achieved while simultaneously leaving the coiled tubing substantially unoccluded. As a result, treatment applications may also be run through the assembly as desired. Such treatment applications may even take place without undue concern over damage to the communication line. Thus, an improved assembly may be realized that reduces time, equipment and expense when running coiled tubing based logging applications followed by treatment applications.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A logging assembly for disposal in a well and comprising:

coiled tubing deployable from a surface adjacent the well;

a fiber optic line disposed in an interior flow path of said coiled tubing and having a degree of slack relative to the coiled tubing, the interior flow path of the coiled tubing substantially un-occluded by the fiber optic line to provide sufficient volume in the coiled tubing for a downhole treatment application; and a logging tool coupled to said fiber optic line and configured to acquire well information for establishing a profile thereof.

2. The logging assembly of claim 1 wherein said fiber optic line is of a weight less than about ⅓ lb. per foot.

3. The logging assembly of claim 1 wherein said fiber optic line is of a weight less than about 25% that of the logging assembly.

4. The logging assembly of claim 1 wherein said fiber optic line comprises:

a fiber optic core; and a protective metal casing about said fiber optic core.

5. The logging assembly of claim 4 wherein said protective casing comprises one of stainless steel, a transition metal nickel, and an austenitic nickel-chromium based superalloy.

6. The logging assembly of claim 4 wherein said fiber optic line comprises one of a fiber for two way multi-frequency communication and separate dedicated one-way communication fibers.

7. The logging assembly of claim 1 further comprising:

a control unit for directing the logging tool;

a transceiver for wireless communication with said control unit, said transceiver disposed at a reel accommodating said coiled tubing at the surface; and a surface opto-electric interface electronically coupled to said transceiver and optically coupled to said fiber optic line to allow a flow of data therebetween.

8. The logging assembly of claim 7 wherein said control unit is a laptop computer.

9. The logging assembly of claim 7 wherein said interface comprises a dedicated port for directing a downhole power source coupled to said logging tool.

10. The logging assembly of claim 1 further comprising a battery coupled to said logging tool.

11. The logging assembly of claim 10 further comprising a downhole opto-electric interface optically coupled to said fiber optic line and electronically coupled to said tool and battery to allow a flow of data between said line and said tool and battery.

12. The logging assembly of claim 11 wherein said opto-electric interface comprises a pressure barrier to isolate said logging tool and said battery from exposure to fluid.

13. A logging tool comprising:

well profile generating equipment;

a downhole power source coupled to said equipment; and an interface coupled to said equipment for acquiring optical data from a fiber optic line disposed in an interior portion of coiled tubing, the optical data being utilized to direct said equipment, the interface further utilized to communicate data from the equipment to a surface of an oilfield, the interior portion of the coiled tubing substantially un-occluded by the fiber optic line such that a well treatment application may be performed.

14. The logging tool of claim 13 wherein said interface is further coupled to said downhole power source for directing thereof.

15. The logging tool of claim 13 wherein the well profile is a production profile revealing one of well pressure, temperature, tool location, formation density, surrounding gas, fluid flow, velocity, water content, and imaging.

16. An assembly comprising:

coiled tubing deployable from an oilfield surface adjacent a well defining an single channel therein;

an interventional treatment device coupled to said coiled tubing for performing an interventional application relative to the well; and a logging tool coupled to said coiled tubing and configured to acquire well information for establishing a profile thereof; and a fiber optic line disposed within the channel of said coiled tubing in a substantially un-occlusive manner and coupled to said logging tool.

17. The assembly of claim 16 wherein said coiled tubing comprises an inner diameter of at least about 1 inch which defines the channel, said fiber optic line having a diameter of less than about 0.25 inches.

18. The assembly of claim 16 wherein the application is one of a cleanout, stimulation, fracturing, isolation, perforating, fishing, milling, and casing sleeve shifting.

19. The assembly of claim 18 wherein the cleanout comprises acidizing.

20. A method of logging a well to establish a profile thereof, the method comprising:

deploying a fiber optic tether through an interior of a coiled tubing from an oilfield surface adjacent the well the fiber optic tether having a degree of slack relative to the coiled tubing;

coupling the coiled tubing and the fiber optic tether to a logging tool and a treatment tool for advancement into the well, the fiber optic tether providing sufficient volume within the coiled tubing interior to allow fluid flow therethrough to perform a treatment application; and performing at least one logging application with the logging tool.

21. The method of claim 20 further comprising directing the logging over the fiber optic line from a control unit at the surface.

22. The method of claim 21 wherein said directing comprises employing a control unit to wirelessly communicate with the fiber optic line at a coiled tubing reel positioned at the surface.

23. The method of claim 21 further comprising performing a treatment application in the well with the treatment tool following said directing based on the profile acquired from the logging.

24. The method of claim 23 further comprising coupling the treatment tool to the coiled tubing prior to said directing, said performing being in real-time relative to said directing.

25. The method of claim 20, wherein deploying the fiber optic line through the coiled tubing is accomplished by pumping a fluid into the coiled tubing.

26. The method of claim 23 wherein performing comprises performing a cleanout application, a stimulation application, a fracturing application, an isolation application, a perforating application, a fishing application, a milling application, and/or a casing sleeve shilling application.

* * * * *